US006003952A

United States Patent [19]

Smart et al.

[11] Patent Number: 6,003,952

[45] Date of Patent: Dec. 21, 1999

[54] UNDERWATER MINING MACHINE

[76] Inventors: Leslie Robin Smart, 38 Weltevreden Avenue, Rondebosch; Michael Estment Dingle, 12 Luisa Way, Hout Bay; Michael John Taylor, 102 Eksteen Street, Loevenstein; Alan Stephen Jones, 2 Korhaan Road, Melkbosstrand, all of Cape Town; Richard Frederick Mann, 4 Disa Avenue, Somerset West; Michael Hayden Spires, 10 Anstea Avenue, Welgedacht, both of Western Cape; Mark Lawrence Jackson, 5 Edinburgh Place, Tokai Hamlet, Tokai, Cape Town; Ignatius Corneluis Claassen, 11 Clubview, Hills Road, Selection Park, Springs; Roberto De Pretto, 92 Frames Close, Fairvale; Kevin David Richardson, 8 Willowdale, Rosen Street, Corlett Gardens, both of Johannesburg, all of South Africa

[21] Appl. No.: 09/046,585

[22] Filed: Mar. 24, 1998

[30] Foreign Application Priority Data

Mar. 25, 1997 [ZA] South Africa ..... 97/2549

[51] Int. Cl.[6] ..... E21C 50/00

[52] U.S. Cl. ..... 299/9; 299/75; 37/324; 37/343

[58] Field of Search ..... 299/8, 9, 30, 75; 37/343, 342, 326, 324, 337

[56] References Cited

U.S. PATENT DOCUMENTS

| | | | |
|---|---|---|---|
| 3,314,174 | 4/1967 | Haggard | 37/313 |
| 3,437,382 | 4/1969 | Meissner | 299/56 |
| 3,724,901 | 4/1973 | Rollins | 299/64 |
| 4,232,903 | 11/1980 | Welling | 299/8 |
| 4,685,742 | 8/1987 | Moreau | 299/8 |
| 4,746,170 | 5/1988 | Etherington et al. | 299/75 |

FOREIGN PATENT DOCUMENTS

| | | |
|---|---|---|
| 0 192 357 | 1/1986 | European Pat. Off. . |
| 195 31 474 | 2/1997 | Germany . |
| 402256792 | 10/1990 | Japan . |
| 402266088 | 10/1990 | Japan . |
| 92/6858 | 9/1992 | South Africa . |
| 95/7262 | 8/1995 | South Africa . |
| 176 1957 | 9/1992 | U.S.S.R. . |

*Primary Examiner*—David Bagnell
*Assistant Examiner*—John Kreck
*Attorney, Agent, or Firm*—Burns, Doane, Swecker & Mathis, L.L.P.

[57] ABSTRACT

An underwater mining machine includes a chassis mounted on a powered drive arrangement for driving the chassis on an underwater surface, the chassis having a front end and a rear end and being adapted to be manoeuvrable and driven in at least a forward direction, a rotatable cutting drum secured to a boom which is attached to a cradle mounted on the chassis, and material gathering arms adapted to gather material which has been excavated or broken up by the cutting drum.

13 Claims, 3 Drawing Sheets

UNDERWATER MINING MACHINE

BACKGROUND TO THE INVENTION

THIS invention relates to an underwater mining machine of the type used to recover mineral bearing deposits from the sea bed or other underwater location Underwater mining machines are adapted to gather material from the seabed and transport the material to a processing vessel operating on the surface. The mining machine is generally unmanned and will be controlled by an operator situated on the vessel who is provided with control information from sensors, on board cameras, and other information gathering devices located on the mining machine.

Prior art machines are described in, for example, the specifications of South African patent nos. 95/7262 and 92/6858.

In many underwater mining situations the material to be recovered from the seabed is either covered by an overburden of hard or compacted material, or is itself relatively homogenous and compacted and therefore needs to be broken up before it can be transported to the surface. Diamond bearing gravels, for example, are often covered by an overburden of sand and rock which makes recovery of the gravels that much more problematic.

Prior art machines have not always had the capability of effectively or efficiently dealing with a deep overburden or rock outcrop of any significant size or hardness. Also, prior art machines in attempting to break up the overburden often leave an uneven track on which the machine must travel causing problems with the forward movement of the machine and also decreasing the efficiency of the gathering process.

SUMMARY OF THE INVENTION

According to the invention an underwater mining machine includes:

- a chassis mounted on a powered drive arrangement for driving the chassis on an underwater surface, the chassis having a front end and a rear end and being adapted to be manoeuvrable and driven in at least a forward direction;
- a rotatable cutting drum secured to a boom which is attached to a cradle mounted on the chassis; and
- material gathering means adapted to gather material which has been excavated or broken up by the cutting drum.

The cradle is preferably pivotally mounted on the chassis about a pivot axis which may be inclined. The pivot axis may be inclined at an angle of between 5° and 45°, and preferably at an angle of about 25°. The pivot axis of the cradle is preferably located in substantially the same vertical plane as the centre line of the machine.

The cuing drum may be mounted transversely to the boom.

The cutting dry is preferably wider than the distance between the outer edge of the tracks.

The boom may be formed from at least two elongate sections pivotally connected together.

The machine may include a docking device for docking the machine to a surface vessel.

The machine may also include processing means for grading material gathered by the gathering means.

The material gather means is preferably attached to the cradle.

According to another aspect of the invention an underwater mining machine includes:

- a chassis mounted on a powered drive arrangement for driving the chassis on an underwater surface, the chassis having front end and a rear end and being adapted to be manoeuvrable and driven in at least a forward direction;
- a rotatable cutting drum mounted at or adjacent to the front end of the chassis and having an axis of rotation which is generally horizontal and perpendicular to said forward direction; and
- material gathering means adapted to gather material which has been excavated or broken up by the cutting drum.

These and further features of the invention will be made apparent from the description of a preferred embodiment thereof given blow by way of example. In the description references match the accompanying drawings but the specific features shown in the drawings should not be construed as limiting on the invention

DETAILED DESCRIPTION OF THE ON PREFERRED EMBODIMENT

Figure 1:
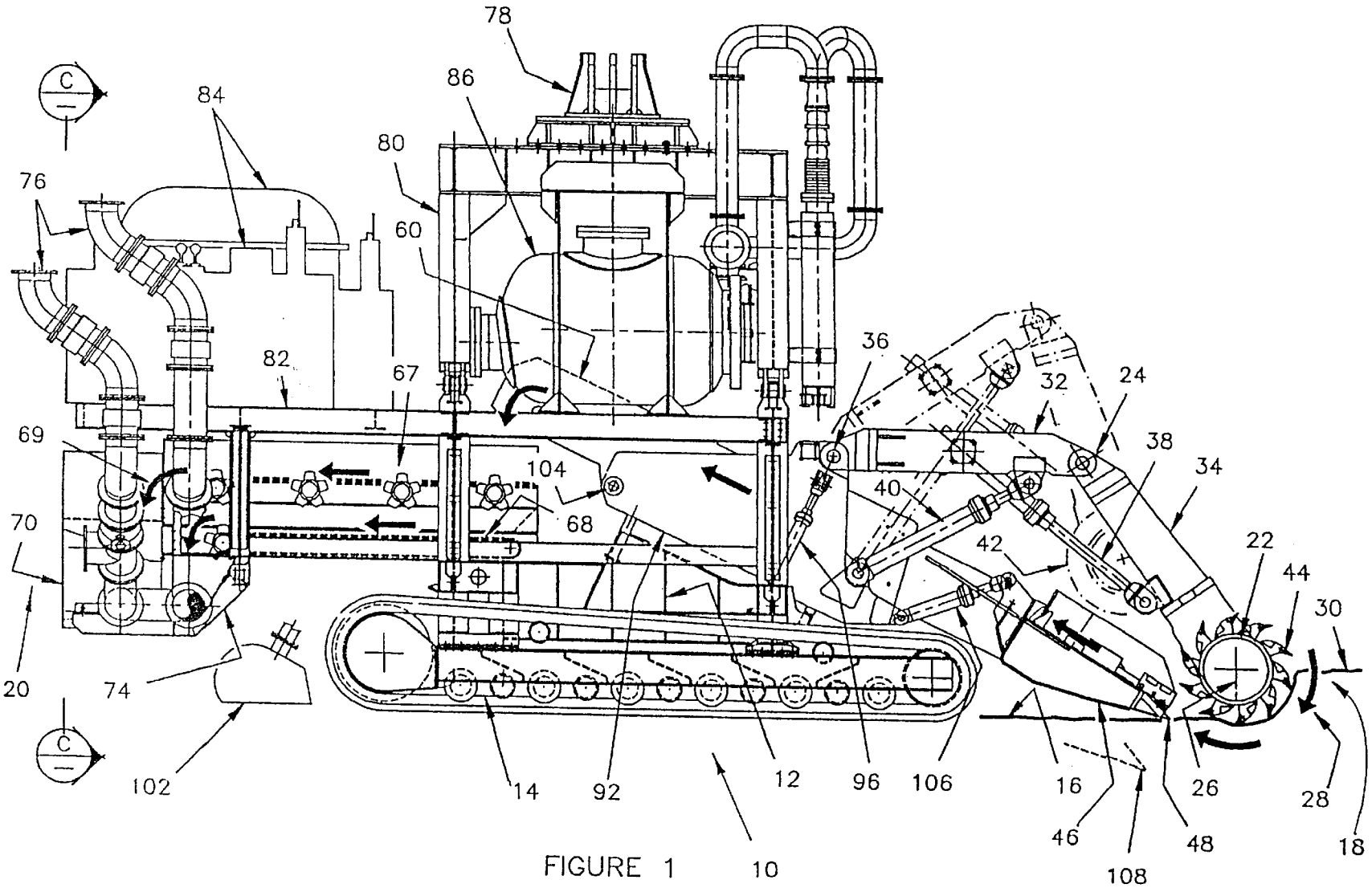
FIG. 1 shows a side view of an underwater mining machine according to the invention.

As shown in the drawings, an underwater mining machine 10 comprises a chassis 12 which is mounted on tracks 14 and is adapted to be driven on an underwater surface 16. The vehicle 10 has a front end 18 and a rear end 20.

A rotatable cutting drum 22 is mounted via a boom 24 to the chassis 12. The drum 22 is rotatable on an axis 26 in the direction of arrow 28 in order to cut a so of material 30 as the machine moves in a forward direction.

The boom 24 is formed in two sections numbered 32 and 34. The section 34 has the cutting drum 22 mounted on the free end thereof, and section 32 is pivotally connected by a pivot assembly 36 to the chassis via a cradle 92. The two sections 32 and 34 are connected together by a hydraulic piston cylinder assembly 311 which is used to vary the angle between the two sections. The boom is raised and lowered by a hydraulic p*son and cylinder assembly 40 and the two piston and cylinder assemblies 38 and 40 are used to position the cutting drum 22 in either a retracted, non-operative position (as indicated by dotted lines 42) or in a position forward therefrom in which the cutting drum is the leading component on the machine.

The cutting drum 22 has a multiplicity of cutting teeth 44 mounted thereon which are angled as shown to optimally cut the material 30 to be excavated by the machine. The cutting teeth 44 are located in a scroll configuration to draw material towards the centre of the drum.

The cutting drum has a width which is wider than the distance between the outer edges of the tracks 14. Thus, the cutting drum will cut a swath through the material 30 which forms a roadway in which the machine can travel. Since the axis of rotation of the cutting drum is generally horizontal that roadway will be basically horizontal and will define a relatively smooth path for the forward travel of the machine.

Figure 2:
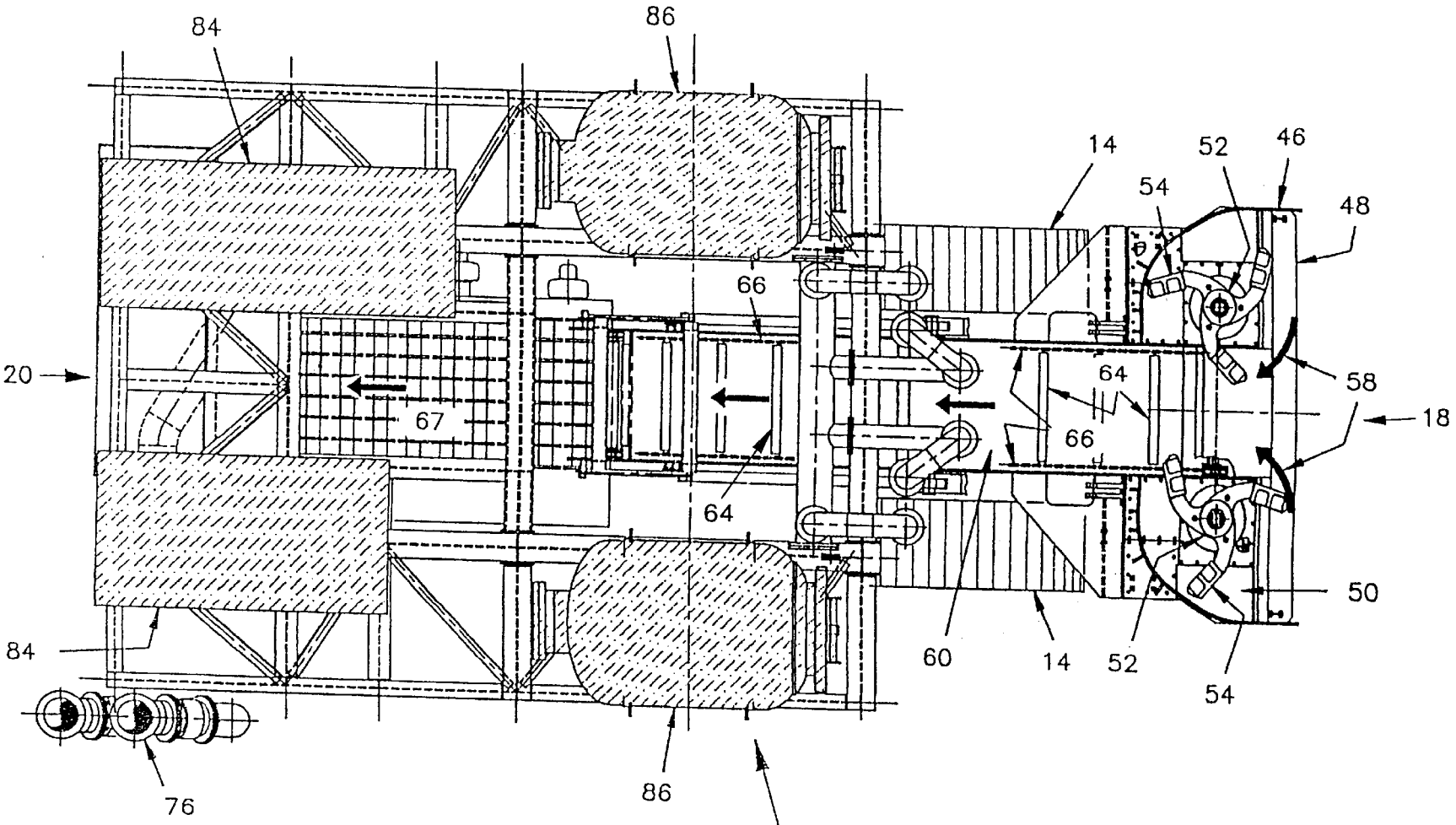
FIG. 2 shows a plan view of the machine shown in FIG. 1 (with the boom and cutter drum removed for clarity)
Figure 3:
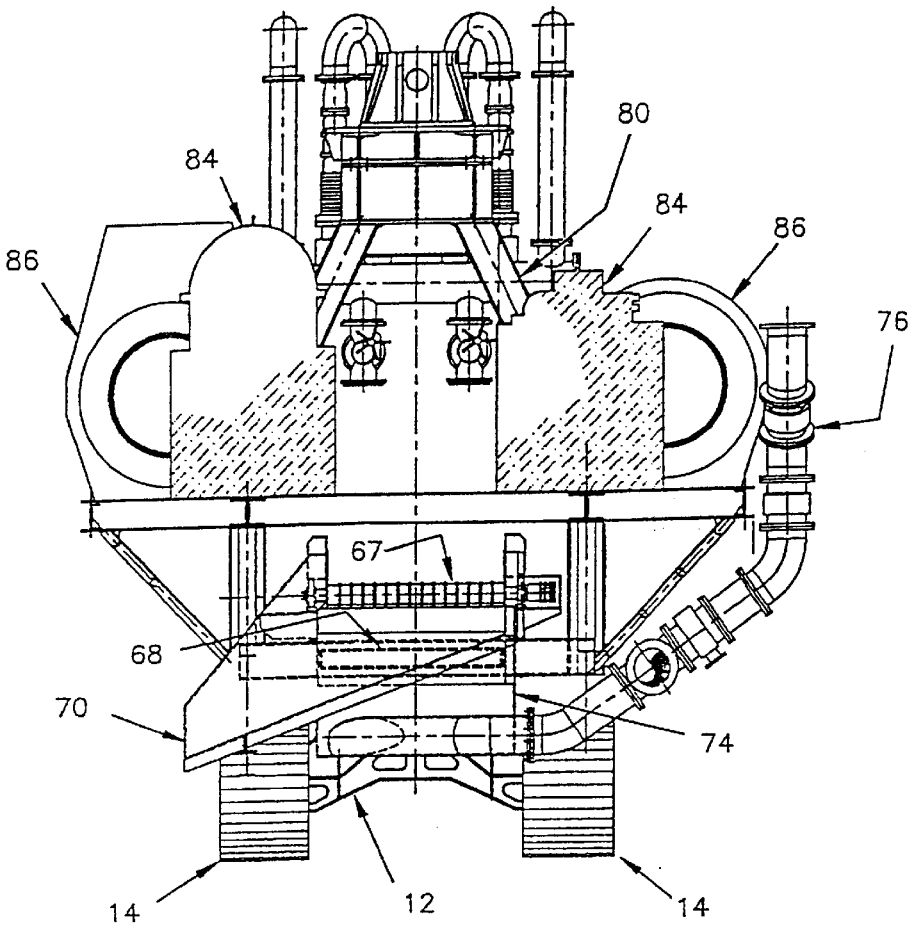
FIG. 3: shows a sectional view along lines C—C depicted in FIG. 1.

Material that has been cut or broken up by the cutting drum 22 will be gathered onto the machine by means of a spade assembly 46. The spade assembly 46 has a sharpened leading end 48 which leads to a generally planar apron 50 best seen in FIG. 2 of the drawings.

A pair of material directing wheels 52 are mounted on the spade and have an axis of rotation which is perpendicular to the plane of the apron 50. The wheels 52 are of star shaped configuration and each has three gathering arms 54 thereon which are adapted to guide or move material on the apron 50 towards the centre thereof The wheels rotate in the direction of arrows 58 so that material anywhere on the apron 50 is directed to the centre of the apron.

A conveyor device 60 is used to transport the gathered material up and back towards the centre of the vehicle for initial processing. The conveyor 60 is of an ox-chain type conveyor comprising a multiplicity of slats 64 which span between chains 66, the chains being driven in a circular path.

The material from the conveyor 60 is deposited on a screen assembly 67 which is designed to allow smaller particles and fine material to pass through the screen onto a lower conveying assembly 68. Coarser particles are moved along the length of the screen assembly 67 to pass off the rear end of the machine as indicated by, arrow 69 through a chute 70. The fine materials are conveyed along the conveyor assembly 68 to a hopper 74 and from there it is transported to the surface by an air lift assembly 76. Air lift assemblies are well known and need not be described herein in any greater detail. The screen will be fitted with an array of high pressure water jets to assist with clay dissaglomeration.

The machine is provided with a docking device 78 which is attached to the chassis by arms 80.

Figure 4:
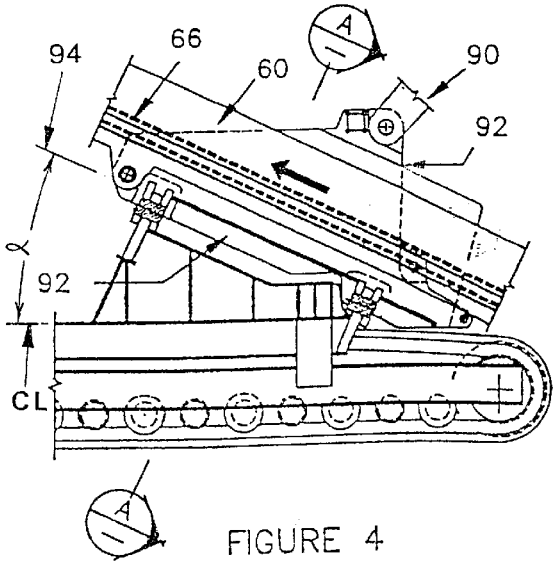
FIG. 4 shows a part longitudinal section along the center line of the machine.
Figure 5:
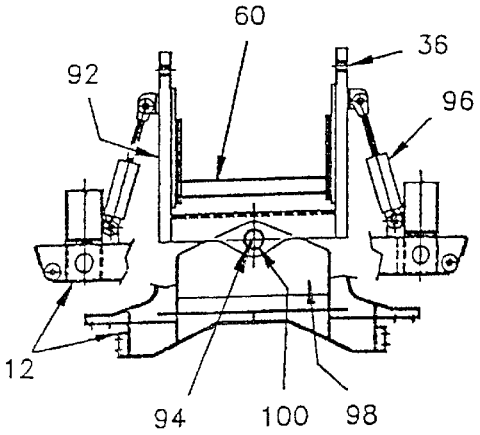
FIG. 5 shows a section along section line A—A depicted in FIG. 4.

The machine is also provided with a platform 82 on which hydraulic power packs 84 and electrical and electronic storage containers 86 are mounted Turning now to FIG. 4 and 5 of the drawings, the means by which the boom 24 is mounted to the chassis is described in more detail. As shown, the section 32 of the boom 24 comprises a pair of arms 90 which are spaced apart by a width greater than the width of the conveyor 60 so that the conveyor 60 travels therebetween. The arms 90 are able to pivot about pivot points 36 as described above. The pivot points 36 are located on the cradle 92 which itself is pivotably connected to the chassis and is able to pivot about pivot axis 94 which is located along the approximate centre line i.e., it extends in a generally forward direction of the driving of the chassis and is located in a vertical plane containing the horizontal center line CL of the vehicle. The pivot axis 94 is inclined of an angle $\alpha$ of approximately 25° to the horizontal whereby the axis descends in the forward direction. The cradle may have multiple degrees of freedom. In one form of the invention the cradle has two degrees of freedom.

The conveyor 60, the spade assembly 46, and the boom 24 are all mounted on the cradle 92 so that pivoting of the cradle 92 about its pivot axis 94 pivots the boom (and hence the cutting drum), the spade 46 and the conveyor 60. This allows the cutting and material gathering components of the machine to be angled relative to the surface 16 on which the tracks 14 are travelling. This can be advantageous in certain excavating situations.

The angle of the cradle 92 relative to the chassis is controlled by a pair of piston and cylinder assemblies 96. It is envisaged that the cradle 92 will be able to pivot through an arc of approximately 12°. Clearly, an arc of greater than this (up to 20°) will be possible although it is envisaged that an arc of 12° should be sufficient for the purposes described. The chassis is provided with mounting brackets 98 within which pivot assemblies 100 are located.

The spade 46 and conveyor 60 are pivotally connected to the cradle 92 via a pivot point 104. The pivot point 104 has a pivot axis which is generally perpendicular to the length of the conveyor 60. The conveyor 60 and spade 46 can be moved so as to pivot about pivot point 104 by means of a pair of hydraulic piston and cylinder assemblies 106. This allows the leading edge of the spade to be lowered (as indicated at dotted lines 108), or raised, and it is envisaged that the length of travel between its fully down and fully up position will be approximately 600 mm Generally, however, the leading edge of the spade will be nominally at the same elevation as the surface 16. However, for inclined terrain or undulating terrain the ability of the spade to move above the nominal level of the tracks or below the nominal level of the tracks will be advantageous and will improve the efficiency of the recovery process.

The preferred arrangement is for the cutting drum and the spade to be approximately 3.9 m wide. The distance between the outer edges of the tracks will preferably be approximately 3.36 m. Thus, there will be a gap between the edge of the excavation and the outer edge of the track on each side of the machine in normal operating conditions. The spade should gather all material from the track so that the path being travelled on by the tracks is relatively smooth. The platform may be wider than the width of the excavated track since it is located above the track and therefore will not come into contact with the surface over which the machine is traveling.

It is will envisaged that the machine will be able to process material at the rate of approximately 530 tons per hour. The maximum speed of the machine in a forward or reverse direction will be approximately 15 m per minute.

The drum should be rotatable at a rotational speed of between 20 and 70 rpm and it is envisaged being powered by 2×120 kW hydraulic motors.

The material directing wheels will be rotatable at speeds of between 0 and 25 rpm and each will be powered by 45 kW hydraulic motors. The spade will be adjustable in height by 300 mm above and below the normal track height The spade will also be able to move laterally by approximately 150 mm each side of the longitudinal centre line of the vehicle.

The conveyor 60 will operate at between 0.25 and 1.5 m per second and will be powered by a 37 kW hydraulic motor. The screen conveyor 68 will operate in a speed range of 0.25 to 2.0 m per second and will be powered by a 25 kW hydraulic motor. The tracks 14 will each be powered by 2×50 kW hydraulic motors and the screen 67 will be operated by 3×7.5 kW hydraulic motors and have a screen capacity of 700 tons per hour. The screen 67 will have a screen cut point size of −100 mm.

With different operating conditions the following performance and speed of operation are envisaged:

| | | | | |
|---|---|---|---|---|
| Cycle 1: (Material centre depth 1.2) | | | | |
| Face Area | = | 1.2 × 3.0 | = | 3.6 $m^2$ |
| Forward speed | = | $\frac{250}{3.6}(m^3/H)$ = | = | 69 m/h |
| Time to complete 1 lane | = | $\frac{100}{69}$ = | = | 87 mins |
| Lift spade and prepare to reverse | | | = | 2 mins |
| Reverse 120 meters | = | $\frac{120}{12}$ = | = | 10 mins |
| Align m/c and cut to depth | | | = | 10 mins |
| Total cycle time | | | = | 80 mins |
| No of cycles/20 hr day | = | $\frac{20\times60}{80}$ = | = | 15 |
| Area/cycle | = | 30 × 100 | = | 100 $m^2$ |
| at 1,2 depth | | Area/day | = | 3300 $m^2$ |
| Cycle 2: (Material depth 0.8) | | | | |
| Face Area | = | 0.8 × 3.0 | = | 2.4 $m^2$ |
| Forward speed | = | $\frac{250}{2.4}(m^3/H)$ = | = | 104 m/h |
| Time to complete 1 lane | = | $\frac{100}{104}$ = | = | 58 mins |
| Lift spade and prepare to reverse | | | = | 2 mins |
| Reverse 120 meters | | | = | 10 mins |
| Align m/c and cut to depth | | | = | 10 mins |
| Total cycle time | | | = | 80 mins |
| No of cycles/20 hr day | = | $\frac{20\times60}{80}$ = | = | 15 |
| Area/cycle | = | 30 × 100 | = | 300 $m^2$ |
| at 0.8 depth | | Area/day | = | 4500 $m^2$ |
| Cycle 3: (Material centre depth 0.5) | | | | |
| Face Area | = | 0.0 × 3.0 | = | 1.5 $m^2$ |
| Forward speed | = | $\frac{250}{1.5}(m^3/H)$ = | = | 167 m/h |
| Time to complete 1 lane | = | $\frac{100}{167}$ = | = | 36 mins |
| Lift spade and prepare to reverse | | | = | 2 mins |
| Reverse 120 meters | | | = | 10 mins |
| Align m/c and cut to depth | | | = | 10 mins |
| Total cycle time | | | = | 58 mins |
| No of cycles/20 hr day | = | $\frac{20\times60}{58}$ = | = | 20.7 |

-continued

| | | | | |
|---|---|---|---|---|
| Area/cycle | = | 30 × 100 | = | 300 $m^2$ |
| at 0.5 depth | | Area/day | = | 6210 $m^2$ |
| Cycle 4: (Material centre depth 0.3) | | | | |
| Face Area | = | 0.3 × 3.0 | = | 0.9 $m^2$ |
| Forward speed | = | $\frac{250}{3.6}(m^3/H)$ = | = | 278 m/h |
| Time to complete 1 lane | = | $\frac{100}{278}$ = | = | 22 mins |
| Lift spade and prepare to reverse | | | = | 2 mins |
| Reverse 120 meters | | | = | 10 mins |
| Align m/c and cut to depth | | | = | 10 mins |
| Total cycle time | | | = | 44 mins |
| No of cycles/20 hr day | = | $\frac{20\times60}{44}$ = | = | 27.3 |
| Area/cycle | = | 30 × 100 | = | 300 $m^2$ |
| at 0.3 depth | | Area/day | = | 8182 $m^2$ |

It is envisaged that a machine of the aforementioned type will operate at depths up to 200 m below sea level. The machine will also carry on board performance monitoring sensors and transducers and will carry standard on board cameras and other guidance aids for the operator. Generally it is envisaged that the machine will cut a lane or swath 3.9 m wide and that the lane will run for 100 m At the end of the 100 m travel, the machine will reverse back to the start of the lane and will then commencing cutting a new lane adjacent the previous lane.

The machine will carry a suction bead located behind the tracks of the vehicle (as indicated at numeral 102) which will suck up any fine material which has not been gathered onto the spade.

Control of the spade in the X,Y & Z plane may be achieved via a sediment depth measurement system.

There may be many variations to the above described embodiment without departing from the scope of the invention however, it is envisaged that a cutting head of the type described herein should prove advantageous over prior art systems which should result in improved recovery of valuable minerals from the seabed or other underwater location where the machine is operated.

We claim:

1. An underwater mining machine comprising:

a chassis mounted on a powered drive arrangement for driving the chassis on an underwater surface, the chassis having front and rear ends and adapted to be maneuverable and driven at least in a forward direction;

a cradle pivotably mounted to the chassis by a first pivot defining a generally forwardly extending axis;

a boom pivotably mounted to the cradle by a second pivot;

a rotatable cutting drum secured to the boom for rotation relative thereto;

tilting means for tilting the cradle sideways about the first pivot;

gathering means pivotably mounted to the cradle by a third pivot for gathering material which has been excavated or broken-up by the cutting drum;

first raising/lowering means for raising and lowering the gathering means relative to the cradle about the third pivot;

a second raising/lowering means for raising and lowering the boom relative to cradle about the second pivot;

screening means for screening the gathered material;

conveying means for conveying gathered material to the screening means; and transporting means for transporting screened material upwardly to a water surface.

2. The machine according to claim 1 wherein the first raising/lowering means includes at least one piston and cylinder assembly extending between the cradle and the gathering means.

3. The machine according to claim 1 wherein the second raising/lowering means includes at least one piston and cylinder assembly extending between the cradle and the boom.

4. The machine according to claim 1 wherein the gathering means comprises a spade assembly disposed adjacent the rotatable drum.

5. The machine according to claim 1 wherein the conveying means is pivotably secured to the cradle.

6. The machine according to claim 1 wherein the cradle is inclined at an acute angle relative to the chassis, with the cradle rising toward the rear end of the chassis.

7. The machine according to claim 1 wherein a longitudinal axis of the cradle is located in substantially the same vertical plane as a center line of the machine.

8. The machine according to claim 1 wherein the drive arrangement includes a pair of tracks each spaced laterally from a longitudinal center axis of the machine, the cutting drum being wider than a distance between outer edges of the tracks.

9. The machine according to claim 8 wherein a rotational axis of the cutting drum extends transversely relative to a longitudinal axis of the boom.

10. The machine according to claim 1 wherein a rotational axis of the cutting drum extends transversely relative to a longitudinal axis of the boom.

11. The machine according to claim 1 wherein the transporting means comprises an air lift assembly.

12. The machine of claim 1 wherein the second and third pivots define respective pivot axes each extending perpendicular to the generally forwardly extending axis of the first pivot as the machine is viewed from above.

13. The machine of claim 12 wherein the generally forwardly extending axis is inclined relative to horizontal, whereby the forwardly extending axis descends in the forward direction.

* * * * *